United States Patent [19]

Pilsinger et al.

[11] Patent Number: 4,937,405

[45] Date of Patent: Jun. 26, 1990

[54] VACUUM SWITCH CHAMBER

[75] Inventors: Günter Pilsinger, Düsseldorf, Fed. Rep. of Germany; Joseph Lipperts, Venlo, Netherlands

[73] Assignee: Calor-Emag Elektrizitäts Aktiengesellschaft, Ratingen, Fed. Rep. of Germany

[21] Appl. No.: 319,135

[22] Filed: Mar. 3, 1989

[30] Foreign Application Priority Data

Mar. 3, 1988 [DE] Fed. Rep. of Germany ..... 3806921

[51] Int. Cl.[5] ..... H01H 33/66

[52] U.S. Cl. ..... 200/144 B

[58] Field of Search ..... 200/144 B

[56] References Cited

U.S. PATENT DOCUMENTS 3,514,559 5/1970 Ranheim ..... 200/144 B

*Primary Examiner*—Robert S. Macon

*Attorney, Agent, or Firm*—Herbert L. Lerner; Laurence A. Greenberg

[57] ABSTRACT

A vacuum switch chamber includes a ceramic body having two ends, two cylinder halves defining an encompassing parting line between the halves and an internal groove along the parting line. Metal caps close both of the ends. Mutually movable conductor bolts penetrate the ends. Switch contacts are disposed on the conductor bolts at a switch location. A two-part shield surrounds the switch location and has bent, adjoining, axially oriented, intermeshing inner and outer ends engaging the internal groove and spanning the parting line. The outer end has tabs distributed over the periphery of the shield and oriented toward the ceramic body.

4 Claims, 2 Drawing Sheets

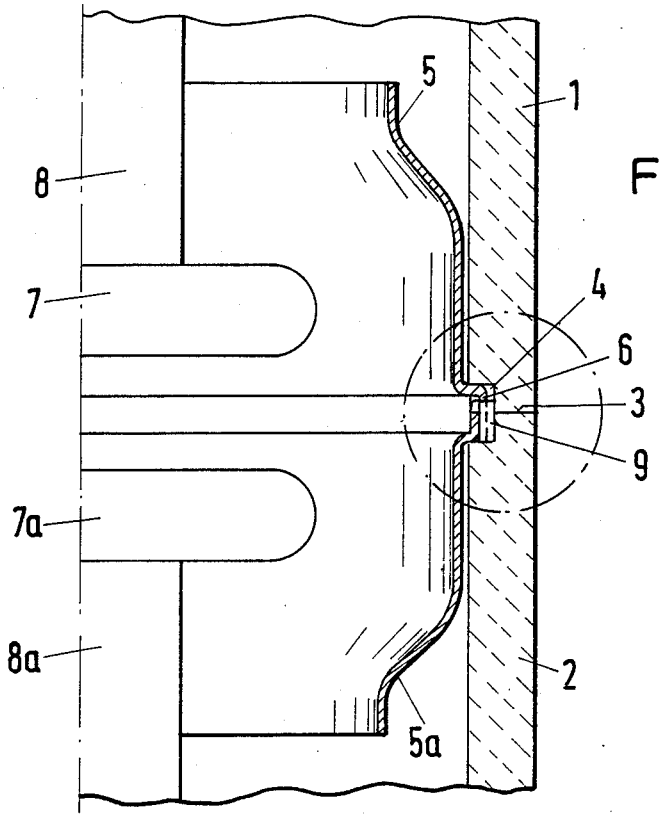
Fig. 1
Fig. 2
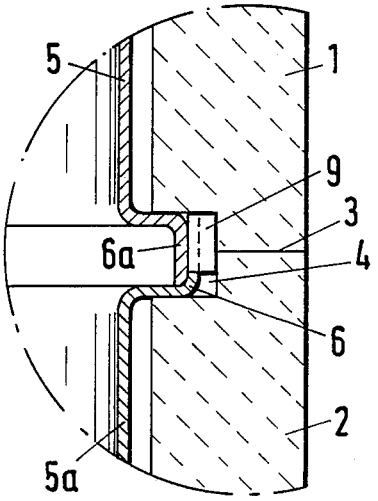
Fig. 3
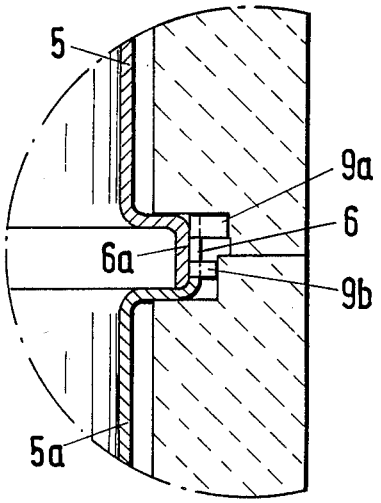

(A-B)

VACUUM SWITCH CHAMBER

The invention relates to a vacuum switch chamber, having a ceramic body formed of two cylinder halves closed on both ends by metal caps, the caps being penetrated by conductor bolts that are movable relative to one another and carry switch contacts, the ceramic body having an internal groove along an encompassing parting line thereof, for retaining a two-part shield surrounding a switch location, the shield having adjoining ends being bent at an angle and engaging the inside of the internal groove.

In a switch chamber of this type, which is known from Published Japanese Application No. 58-181217, the ends of a shield which are bent in the radial direction and protrude into the internal groove, merely serve as fasteners.

In a variation of that type of device, the shield is made in one piece and protrudes into the internal groove with a circumferential tab pressed out from the body of the shield. The parting line of the ceramic body in this case is spanned by the axial portion of the tab. Such a device again serves to fasten the shield, as with the other device described above.

It is accordingly an object of the invention to provide a vacuum switch chamber, which overcomes the hereinaforementioned disadvantages of the heretofore-known devices of this general type and which does so in such a way that in addition to suitably fastening the shield, the fastening can also provide centering for the cylinder halves of the insulating ceramic.

With the foregoing and other objects in view there is provided, in accordance with the invention, a vacuum switch chamber, comprising a ceramic body having two ends, two cylinder halves defining an encompassing parting line between the halves and an internal groove along the parting line, metal caps closing both of the ends, mutually movable conductor bolts penetrating the ends, switch contacts disposed on the conductor bolts at a switch location, a two-part shield surrounding the switch location and having bent, adjoining, axially oriented, intermeshing inner and outer ends engaging the internal groove and spanning the parting line, the outer end having tabs distributed over the periphery of the shield and oriented toward the ceramic body.

With the tabs extended, a reliable central orientation of the cylinder halves is additionally made possible by the shield. The tabs are extended to a slightly larger diameter circle than the internal groove receiving them. Assembly is then performed with a certain pre-stressing, which guarantees firm seating.

The differences in expansion in response to heat between the metal shield and the insulating ceramic, in particular at soldering temperature, are compensated for by the tabs which yield. In selecting the shield material, no special care need be taken to select a particular coefficient of expansion. Thus relatively economical special steel can be used for this purpose.

On one hand, the intermeshing of the shield elements results in a stable shield for assembly purposes, while on the other hand, the tab openings are thus covered by the end of the shield part located toward the inside, and the ceramic body is reliably protected against the effects of arcing.

In accordance with another feature of the invention, the tabs are single-armed tabs formed of partly detached material of the shield. Suitable cutting lines are drawn on for partly detaching the single or multiple-armed tabs from the shield material.

In accordance with a further feature of the invention, the tabs are disposed at each of the cylinder halves and do not fit over the parting line.

If the recesses formed in the cylinder halves to form the internal groove are given tolerances, the tolerances can be compensated for by bringing about a smooth outer ceramic surface and by using tabs for each individual ceramic cylinder. In that case, the tabs need not span the parting line.

In accordance with a concomitant feature of the invention, the tabs have ends firmly soldered to the ceramic body at the parting line.

Other features which are considered as characteristic for the invention are set forth in the appended claims.

Although the invention is illustrated and described herein as embodied in a vacuum switch chamber, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

FIG. 1 is a fragmentary, diagrammatic, sectional view of half of a vacuum switch chamber;

FIGS. 2 and 3 are enlarged views of the portion of FIG. 1 enclosed by a circle in the vicinity of a shield fastening

Figure 4:
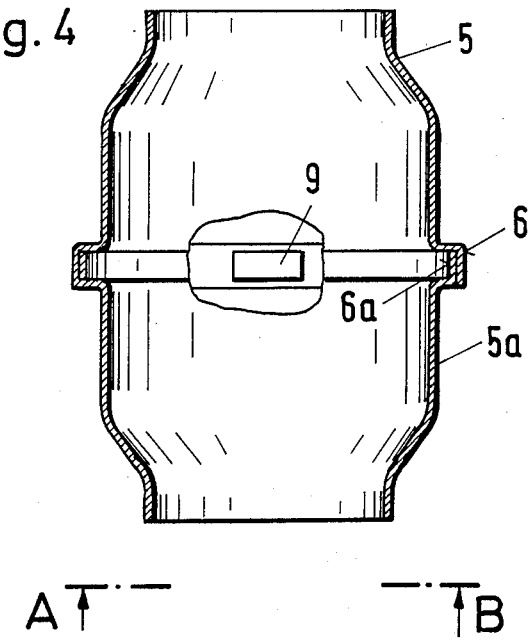
FIG. 4 is a sectional view of the entire screen.

Referring now to the figures of the drawings in detail and first, particularly, to FIGS. 1 and 2 thereof, there is seen an insulating jacket casing of the vacuum switch chamber formed of a ceramic body assembled from two cylinder halves 1, 2. Metal caps close both of the ends of the ceramic body. These halves are stacked one upon the other with an axial alignment, and are joined firmly together at a parting line 3 thereof by soldering. On both sides of the parting line, the halves are recessed stepwise so that they have a larger diameter, in order to form an internal groove 4.

A metal shield disposed inside the vacuum switch chamber and coaxially surrounding the switch contacts is formed from bell-shaped parts 5, 5*a*. Ends 6, 6*a* of the parts 5, 5*a* which widen in cup-like fashion are capable of being inserted into one another. The outer end 6 having the larger diameter fits over the inner end 6*a*.

The ends form a ring protruding in the radial direction, with which the shield engages the groove 4 in the ceramic body for fixation. The outer end 6 of the part 5 covers the parting line 3 with a portion thereof extending in the axial direction. Single-armed, retractable tabs 9 extend outward from the end 6 in the direction of the ceramic body. As shown in FIGS. 1 and 2, these tabs which are distributed over the periphery also cover the parting line 3. The diameter of the circle defined by the ends of the extending tabs is selected to be somewhat larger than the inside diameter of the groove 4 in the ceramic body.

In the assembly of the so-called soldered group of the vacuum switch chamber, the cylinder halves 1, 2 of the ceramic body are first fitted over the assembled shield.

To this end, the extending elastic tabs 9 must be pressed inward to a slight extent in the direction of the center of the circle. This guarantees a firm seat of the shield in the ceramic body. As additional fastening means, it is possible to solder the ends of the tabs with the parting line 3 when it is soldered. This brings about a reliable equalization of potential between the shield and the conductive parting line 3 that leads to the outside. With the aid of the extending tabs 9, the cylinder halves 1, 2 can be centered without further effort as soon as the assembly is performed, from the internal groove inward. This centering is maintained even at soldering temperature, despite differing temperature coefficients and the tabs simply yield inward to a greater extent.

Figure 5:
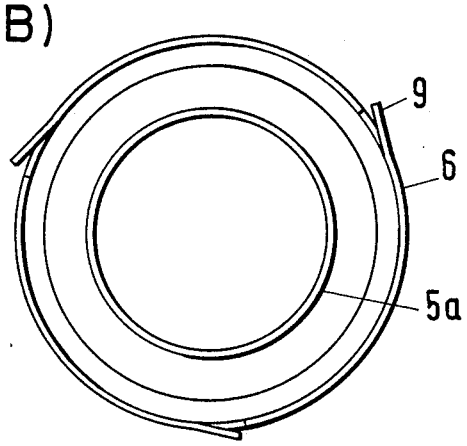
FIG. 5 is a plan view of the shield taken along the line S–B of FIG. 4, in the direction of the arrows.

In FIG. 3, the cylinder halves are recessed with different diameters to form the internal groove 4. In order to permit compensation of these tolerances for forming a ceramic body that is flush on the outside, two tabs 9*a*, 9*b* are located one above the other in the axial direction. These tabs are each assigned as centering aids to one of the cylinder halves 1, 2 and are set back from the parting line 3, so as to maintaining some distance from it. As FIG. 3 clearly shows, the tolerance compensation is achieved due to the fact that the tab 9*b* has been pressed inward by a greater extent than the tab 9*a* located above it. These tabs, like the tabs 9 shown in the other figures, are preferably made by partly detaching the material of the outer ends 6 of one shield part by means of suitably located cutting lines, and extending them as shown in FIGS. 4 and 5.

For the sake of completeness, FIG. 1 also shows switched-off switch contacts 7, 7*a* at a switch location and conductor bolts 8, 8*a* thereof which pass through the metal caps for the vacuum switch chamber.

The foregoing is a description corresponding in substance to German Application No. P 38 06 921.0, dated Mar. 3, 1988, the International priority of which is being claimed for the instant application, and which is hereby made part of this application. Any material discrepancies between the foregoing specification and the aforementioned corresponding German application are to be resolved in favor of the latter.

We claim:

1. Vacuum switch chamber, comprising a ceramic body having two ends, two cylinder halves defining an encompassing parting line between said halves and an internal groove along said parting line, metal caps closing both of said ends, mutually movable conductor bolts penetrating said ends, switch contacts disposed on said conductor bolts at a switch location, a two-part shield surrounding said switch location and having bent, adjoining, axially oriented, intermeshing inner and outer ends engaging said internal groove and spanning said parting line, said outer end having tabs distributed over the periphery of said shield and oriented toward said ceramic body.

2. Switch chamber according to claim 1, wherein said tabs are single-armed tabs formed of partly detached material of said shield.

3. Switch chamber according to claim 1, wherein said tabs are disposed at each of said cylinder halves and do not fit over said parting line.

4. Switch chamber according to claim 1, wherein said tabs have ends firmly soldered to said ceramic body at said parting line.

* * * * *